US007320282B2

(12) United States Patent
Groβ

(10) Patent No.: US 7,320,282 B2
(45) Date of Patent: Jan. 22, 2008

(54) CYLINDERS OF A WEB-FED PRINTING PRESS WITH AXIALLY DISPLACEABLE HOLDING DEVICE

(75) Inventor: Reinhard Georg Groβ, Dettelbach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 356 days.

(21) Appl. No.: 10/524,419

(22) PCT Filed: Jun. 5, 2003

(86) PCT No.: PCT/DE03/01847

§ 371 (c)(1),
(2), (4) Date: Feb. 14, 2005

(87) PCT Pub. No.: WO2004/018206

PCT Pub. Date: Mar. 4, 2004

(65) Prior Publication Data

US 2005/0241511 A1 Nov. 3, 2005

(30) Foreign Application Priority Data

Aug. 12, 2002 (DE) ..... 102 36 865

(51) Int. Cl.
*B41F 27/12* (2006.01)

(52) U.S. Cl. ..... 101/415.1; 101/378; 101/DIG. 36

(58) Field of Classification Search ..... 101/415.1, 101/378, DIG. 36
See application file for complete search history.

(56) References Cited

U.S. PATENT DOCUMENTS

| | | | |
|---|---|---|---|
| 4,707,902 | A | 11/1987 | Kunkel et al. |
| 4,748,911 | A | 6/1988 | Kobler |
| 4,831,931 | A | 5/1989 | Jeschke et al. |
| 5,284,092 | A | 2/1994 | Simeth |
| 5,419,248 | A | 5/1995 | Brotzman |
| 5,806,431 | A | 9/1998 | Muth |
| 5,913,267 | A | 6/1999 | Britsch |
| 6,025,671 | A | 2/2000 | Boecking |
| 6,382,103 | B1 | 5/2002 | Rauh |
| 6,553,908 | B1 | 4/2003 | Richards et al. |
| 6,561,094 | B1 | 5/2003 | Schneider et al. |

FOREIGN PATENT DOCUMENTS

| | | | |
|---|---|---|---|
| DE | 42 10 897 | C1 | 8/1993 |
| DE | 44 44 062 | A1 | 9/1995 |
| DE | 41 40 022 | C2 | 1/1996 |
| DE | 195 10 250 | C1 | 5/1996 |
| DE | 195 16 368 | A1 | 11/1996 |
| DE | 197 12 923 | A1 | 10/1998 |
| DE | 197 57 895 | C2 | 10/1999 |
| DE | 199 24 786 | A1 | 12/2000 |
| DE | 101 36 422 | A1 | 3/2002 |
| EP | 0 229 892 | B1 | 3/1991 |
| EP | 0 808 714 | B1 | 8/2000 |
| EP | 1 193 059 | A1 | 4/2002 |

*Primary Examiner*—Leslie J Evanisko
(74) *Attorney, Agent, or Firm*—Jones Tullar Cooper, PC

(57) ABSTRACT

A cylinder of a printing unit of a web-fed printing press includes a cylinder channel which receives plate ends and includes plate end retaining devices. A remotely controllable actuating device or an actuator is located in the channel. The actuating device, or actuator is preferably a piezoelectric system or is in the form of a magnetostrictive system. This actuator is usable, preferably during continuous printing, to shift a plate end retaining device inside the channel in an axial direction of the cylinder to achieve an improved register precision and lateral register precision. The device makes it possible to counteract the influence of a transverse strain imposed by the material to be printed and acting transverse to its direction of conveyance, such a transverse strain having an effect on a common printed image that is printed at different positions of the printing unit.

21 Claims, 3 Drawing Sheets

CYLINDERS OF A WEB-FED PRINTING PRESS WITH AXIALLY DISPLACEABLE HOLDING DEVICE

CROSS-REFERENCE TO RELATED APPLICATIONS

This U.S. patent application is the U.S. national phase, under 35 USC 371, of PCT/DE2003/001847, filed Jun. 5, 2003; published as WO 2004/018206 A1 on Mar. 4, 2004, and claiming priority to DE 102 36 865.1, filed Aug. 12, 2002, the disclosures of which are expressly incorporated herein by reference.

FIELD OF THE INVENTION

The present invention is directed to cylinders of a web-fed printing press and to a printing unit. Each cylinder includes at least one cylinder groove that carries an actuator which is usable to axially shift a dressing end holding device in the groove.

BACKGROUND OF THE INVENTION

A setting arrangement for use in accomplishing the lateral registration of printing plates is known from DE 197 57 895 C2. Beveled or angled edges of the printing plates are held in a narrow slit of a forme cylinder and each one of the plate edges has a registration cutout, with which cutout a registration pin, that is fastened on an axially displaceable insert strip assigned to the latter, can be respectively brought into engagement. An end of each of the insert strips is provided with an adjustment device for use in effecting an axial back-and-forth movement of each strip. This adjustment device is embodied in such a way that each insert strip is angled off in an L-shape at one of its ends. The angled piece is fastened to the front end of the forme cylinder by the use of a screw.

A plate cylinder, with an adjustable lateral registration, is known from EP 0 229 892 B1. Small register plates are axially displaceable in the cylinder groove by the use of a lateral register adjustment device. The lateral register adjustment device has rotatable spindles and an adjusting screw.

A device for the correctly registered alignment of a rubber blanket on a cylinder of a printing group is known from U.S. Pat. No. 4,707,902. Clamping devices, which are arranged in a groove and which can be actuated by a bracing spindle, can be axially displaced via a manually adjustable threaded ring or by an adjustment screw.

A plate cylinder with an adjustable bracing rail is known from DE 42 10 897 C1. The adjustable bracing rail, which is arranged in a groove of the plate cylinder, can be displaced in a plane via structural roller ring units fastened on the bottom of the groove. Axial displacement takes place by the use of a pin, which pin engages the underside of the bracing rail and is connected with an eccentric device. The eccentric device extends from the interior of the cylinder through the bottom of the groove and can be displaced by operation of a gear driven by a motor.

A device for bracing a printing plate on a plate cylinder of a printing press is known from DE 41 40 022 C2. Clamping devices for the front edge of the plate and for the rear edge of the plate are situated in an axially extending groove of the cylinder. The clamping device for the front edge of the plate can be adjusted in the axial direction of the cylinder by adjustment device. The adjustment device can be displaced by an electric drive motor that is housed in the cylinder. An adjusting shaft of the drive motor projects perpendicularly from the interior of the cylinder into the groove. A rotating movement of the adjusting shaft is converted into an axial adjusting movement.

A device for axially positioning a printing plate is known from EP 0 808 714 B1. In the course of its mounting, the printing plate can be positioned with exact lateral registration by the use of an electrical positioning drive while being moved toward a cylinder.

A device for use in accomplishing the displacement of at least one registration element of a printing press is known from DE 101 36 422 A1. In one embodiment of the device, piezo-actuators are provided for position adjustment. Such a position change takes place in the circumferential direction.

A device for use in the bracing/clamping of flexible plates with beveled suspension legs on a printing press cylinder is known from DE 199 24 788 A1. A base body, with bracing and/or clamping elements, which are movable in the base body's interior space, is arranged in a cylinder groove.

A device for adapting the position of printing plates in response to deformation of the paper to be imprinted is known from DE 195 16 368 A1. A position of a punched-out place on a printing plate, which is provided for receipt of a registration pin, and which is used for accomplishing the adjustment of the printing plates arranged on a forme cylinder of a printing press, is adapted to correspond to a lateral extension or fan out of the paper, which fan out is to be expected in the course of the passage of the paper through plurality of print positions of the printing press, which are arranged serially one behind the other.

SUMMARY OF THE INVENTION

The object of the present invention is directed to providing cylinders of a printing press and to providing a printing unit which will compensate for the lateral extension or fan out of the material to be imprinted.

In accordance with the present invention, the object is attained by the provision of at least one groove in a cylinder, which is a part of each one of serially arranged print positions. The groove carries at least one dressing end holding device that is shiftable over an actuating path oriented axially in the cylinder by the operation of an actuator. That actuator changes its length axially with respect to the cylinder in response to a control signal. Several axially spaced dressings may be arranged on the cylinder and the actuator can be used to change an axial spacing between these dressings. This actuator may be electrically operable. When a multi-color image is applied to a web by passage of the web through serially arranged print positions, the actuators at each position can be used to compensate for lateral fan out of the web.

The advantages to be gained by the present invention consist, in particular, in that it is possible by the accomplishment of a lateral displacement of a holding device arranged in the groove, or of a base body, to align the position, as necessary, of a dressing, which dressing has been applied to a cylinder and which dressing is held by the holding device, in relation to a material to be imprinted. The material to be printed is often stretched laterally with respect to the production direction, or in comparison with other print positions in the printing unit. Alignment or shifting of the dressing is used for obtaining an improved indexing, as well as for lateral registration accuracy. This matching of the dressing position with the lateral web displacement can be performed by the use of an electrical control signal which can be issued by remote control, from, for example, a control console, during the running production process, without it being necessary to stop the printing unit. The tracking of the print images which are to be brought into congruence, can be expanded into an automatically acting control circuit, which automatically acting control circuit relieves the operators from accomplishing this task. Otherwise, the checking of the indexing, as well as the lateral registration accuracy is a task of the operators monitoring the printing process.

It is particularly effective that it is possible, in accordance with the present invention, to arrange the actuating device for use in displacing a holding device, or a base body, integrated into the groove, and in particular into a cylinder groove that is extending underneath the surface area of the cylinder. The cylinder groove only has a slit-shaped opening facing toward the cylinder surface area. The integration of the actuating device for use in displacing a holding device, or a base body, in the groove allows such actuating devices to be retrofitted to a cylinder that is already in operation, because no extensive intervention is required. By the selection or provision of an appropriate shaping, it is possible to fit the actuating device into the groove in an advantageous manner.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
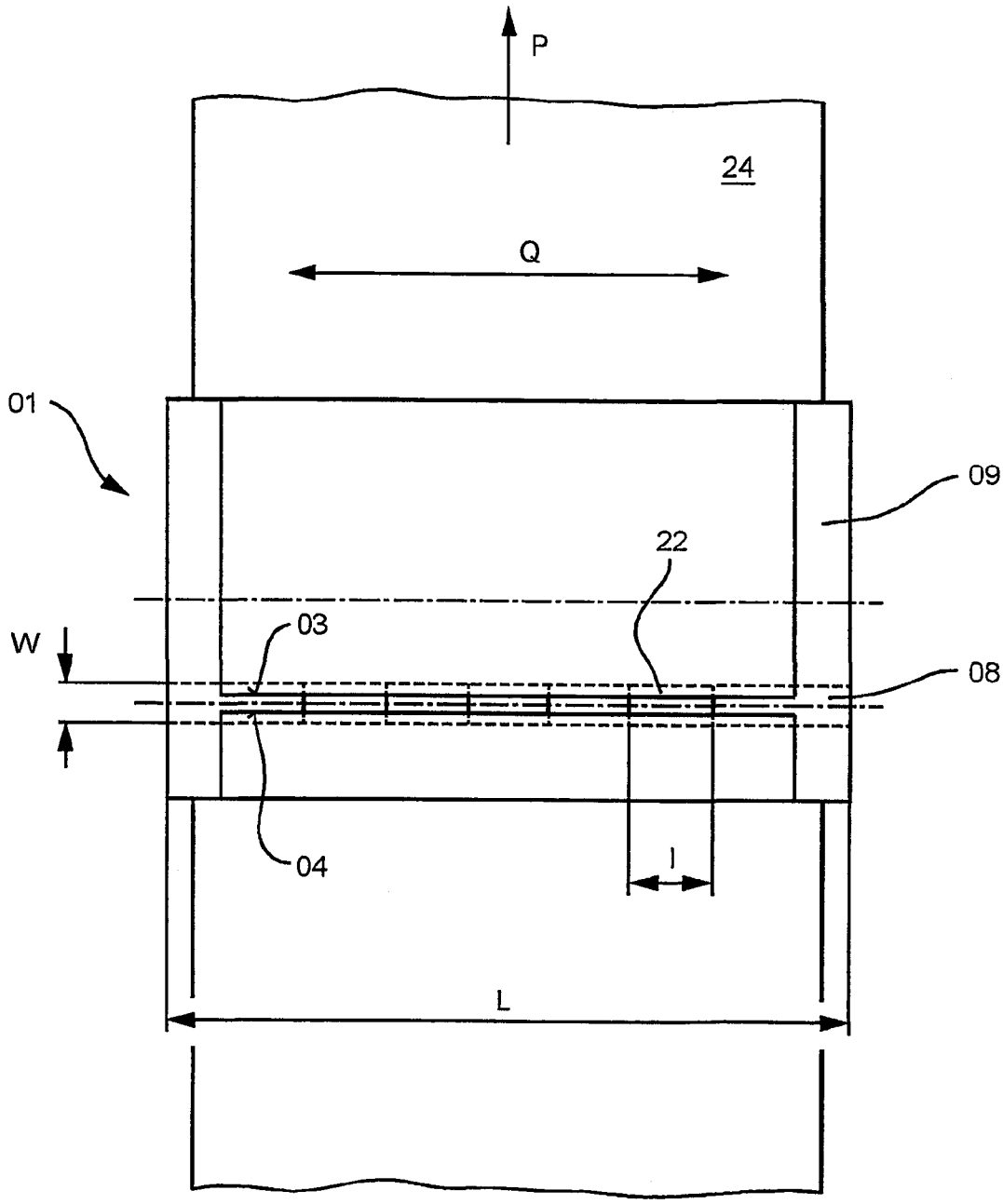
FIG. 1, a schematic depiction of the passage of material to be imprinted extending underneath a cylinder of a printing unit in accordance with the present invention, in FIG. 2, a partial sectional representation of a portion of a cylinder with a groove and with a holding device for a dressing arranged in that groove, and in FIG. 3, a partial cross-sectional representation of an actuator in a groove in a cylinder in accordance with the present invention.
Figure 2:
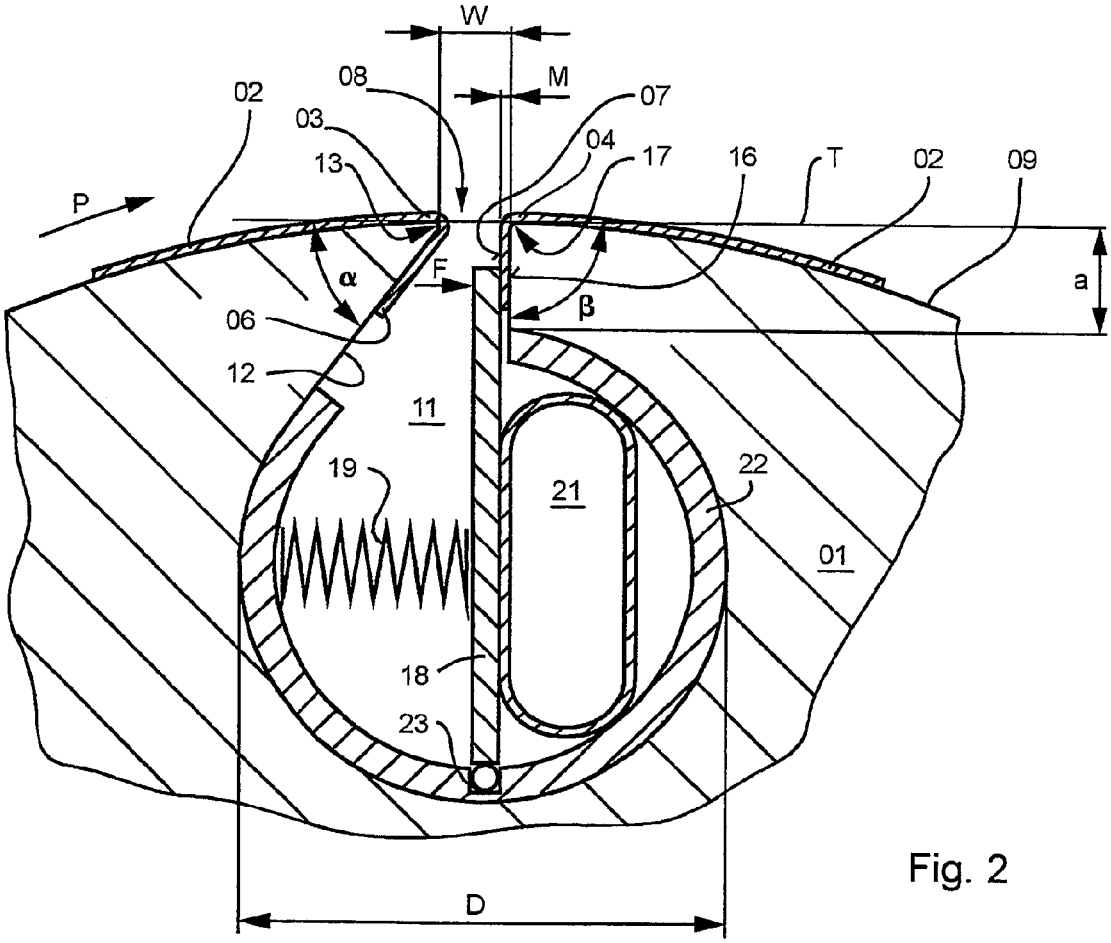

Referring initially to FIG. 1 and taken in conjunction with FIG. 2, a cylinder 01 in a printing unit, such as, for example, a forme cylinder 01 or a transfer cylinder 01 in a rotary printing unit, and preferably such a cylinder 01 in a printing unit of a web-fed offset printing press for newspaper printing, can be provided with at least one dressing 02, as shown in FIG. 2. Such a dressing 02, which may be applied to a forme cylinder, can be embodied as a preferably flexible, plate-shaped printing forme 02, or as a dressing 02 to be applied to a transfer cylinder 01, such as a printing blanket applied to a transfer cylinder 01. The dressing 02 has suspension legs 06, 07, at its ends 03, 04 which legs 06, 07 are beveled. These dressing end suspension legs 06, 07 can each be inserted into a slit-shaped opening 08 that is located in the surface area 09 of the cylinder 01, which slit-shaped opening 08 preferably extends axially in respect to the cylinder 01. The inserted dressing end suspension legs 06, 07 are preferably held by a holding device, with that holding device being located in a cylinder groove 11. The cylinder groove or channel 11 preferably extends axially, in relation to the cylinder 01, underneath the surface area 09 of the forme cylinder 01 and is accessible through the opening 08. The purpose of the dressing end leg holding device is, inter alia, to fix the dressing 02, which has been applied to the surface area 09 of the cylinder 01 in place in the axial direction of the cylinder 01. This function can be performed by, for example, a dressing end holding element 18, that may be embodied as a registration pin, and which is carried on, or by the holding device.

Advantageously, the cylinder groove or channel 11 can be embodied in the interior of the cylinder 01 at a radial distance "a" of, for example, 4 mm to 10 mm, and preferably of 5 mm, underneath the cylinder surface area 09, as a preferably circular bore, and can have a diameter D of, for example from 25 mm to 50 mm, and preferably of 30 mm. A ratio of the diameter of the cylinder 01 to the diameter of groove 11 preferably lies approximately at 10:1. If the cross-sectional shape of the groove 11 is not circular, a ratio of a cross-sectional surfaces of the cylinder 01 to a cross-sectional surface of the groove 11 is at least 100:1, so that the cross-sectional surface of the groove 11 is always comparatively small compared to that of the cylinder 01.

Preferably, at least the ends 03, 04 of the dressing 02 are made of a metallic material, such as, for example, an aluminum alloy. Customarily, the thickness M of the material of the suspension legs 06, 07, which are beveled or angled off at the ends 03, 04 of the dressing 02, is a few tenths of a millimeter and lies, for example, in a range between 0.2 mm and 0.4 mm, and preferably is 0.3 mm.

It is advantageous to suspend a first one of the suspension legs 06, 07 of the dressing 02 in the cylinder 01 from a first opening wall 12 in a positively connected manner. This first opening wall 12 typically extends from a first or leading opening edge 13 of the opening 08, which edge 13 is leading in the production direction P of the cylinder 01, and which first opening wall 12 extends from edge 13 toward the interior of the groove 11. The angle at the typically leading end 03 of the dressing 02 existing between the beveled suspension leg 06 and the rest of the dressing 02, which is stretched out essentially flat on the cylinder surface area 09 preferably corresponds to the angle $\alpha$ which results between this first opening wall 12 extending toward the interior of the groove 11, and an imagined tangential line T resting on the opening 08. The other, second typically trailing suspension leg 07 of the dressing 02 can also be placed against a second trailing, opening wall 16 in the cylinder 01. This second opening wall 16 extends from a second edge 17 of the opening 08, which is trailing in the production direction P of the cylinder 01, toward the interior of the groove 11. The angle formed at a typically trailing end 04 of the dressing 02 existing between the beveled suspension leg 07 and the dressing 02 which is stretched out essentially flat again advantageously corresponds to the angle $\beta$ which results between this second, trailing edge wall 16 extending toward the interior of the groove 11, and an imagined tangential line T resting on the opening 08. It is advantageous to make the angle $\alpha$ between 40° and 50°, preferably 45°, and to make the angle $\beta$ between 80° and 95°, preferably 90°. The dressing trailing end suspension leg 07 placed against the second, trailing edge wall 16 is preferably beveled at the same angle $\beta$. A bevel of the suspension leg 07 between 80° and 85°, and in particular at 83°, is advantageous. The slit width W of the opening 08 is less than 5 mm and preferably lies in the range of between 1 mm to 3 mm, so that a ratio of the diameter of the cylinder 01 and the slit width W preferably lies approximately at 100:1.

In accordance with a preferred embodiment of the present invention, the holding device arranged in the groove 11 consists of at least one dressing end holding element 18, preferably a dressing end clamping piece 18, and a spring element 19, wherein a suspension leg 06 or 07 of the dressing 02 inserted into the opening 08 is preferably placed against the second wall 16 extending from the opening 08 to the groove 11 and is pressed against that second wall 16 by the clamping piece 18 by a force F which is exerted by the spring element 19 on the clamping piece 18. A first holding element actuating device, generally at 21 is provided in the groove 11 for use in releasing the clamping force which, holding element actuating device 21, when actuated, counteracts the force F exerted by the spring element 19 on the clamping piece 18, and pivots the clamping piece 18 away from the second wall 16 of the opening 08. A hose 21 which can be charged with a pressure medium, such as, for example, compressed air, is preferably provided as the first holding element actuating device 21 for actuating the holding device 18 and is advantageously placed to extend continuously in the groove 11, so that all holding devices 18 arranged in a groove 11 can be simultaneously actuated by the first holding element actuating device 21.

For easier mounting in the groove 11, the holding device 18, together with its first actuating device 21, can be arranged in a base body 22, wherein this base body 22 can be advantageously configured essentially as a hollow body, whose exterior contour is essentially matched to the contour of the groove 11. The base body 22 is preferably supported, fixed against relative rotation, in the groove 11. The clamping piece 18 is seated in a pivot bearing 23 in the interior of, or on the bottom of this base body 22. It can be advantageous to embody a plurality of the base bodies 22 as section pieces each of a length l, as seen in FIG. 1 of, for example, 30 mm to 100 mm, and preferably of 60 mm, wherein the length l of an individual base body 22 is short compared to an overall length L of the barrel of the cylinder 01. Several, preferably identical base bodies 22 can be arranged in a row in the groove 11 for use in holding the dressing 02. These individual base bodies 22 can be connected to each other by couplings which are formed on their front or end faces. For example, these couplings can consist of toothed connections, tongue-and-groove connections or pin connections A material 24 to be imprinted in the printing unit is depicted schematically in FIG. 1 and may be, for example, paper 24. Paper 24 is a three-dimensional, hygroscopic material, which changes its shape under the effects of temperature, humidity and mechanical pressure generated during the printing process, by the application of forces acting on the surface of the paper. Of particular interest in the context of the present invention is a lateral extension, depicted by the arrow Q in FIG. 1, of the paper. This lateral extension Q is the so-called fan out, by which is meant a dimensional change of the material 24 to be imprinted, in this case the paper web 24 or the paper sheet 24, which dimensional change is taken or measured transversely to the production direction P of the cylinder 01.

The lateral extension or fanning out Q of the material 24 to be imprinted leads to problems, particularly in a printing unit in which the material 24 to be imprinted is to be printed in more than one color. The printing unit, which is not specifically depicted, can be embodied, for example, as a nine-cylinder satellite printing unit, in which four pairs of cylinders 01, each consisting of a forme cylinder 01 and of a transfer cylinder 01, are arranged in a frame around a common counter-pressure cylinder. Each such pair of cylinders 01 constitutes a print position and prints a definite color, which will form part of the same printed image, on the material 24 to be imprinted. Even with a printing unit embodied as a nine-cylinder satellite printing unit, and in which the four print positions responsible for the individual colors are arranged next to each other in a narrow space, the material 24 to be printed still travels over a path of up to 1 m in length until all four colors for a common printed image have been applied to the material 24 to be imprinted. With different configurations of the printing unit, the path traveled by the material 24 to be imprinted, from the printing of a first color to the printing of a last color of a common multi-colored printed image is even much longer. For example, this path may be longer than 3 m. The dimensional change of the material 24 to be imprinted, because of the lateral extension or fanning out Q, can be correspondingly greater and is long-lasting or permanent. If, on its way from one print position to the next, the material 24 to be imprinted changes in its dimensions transversely to the production direction P of the cylinder 01, an inaccurate fit between color points which are to be printed next to, or above each other, and of which color points the printed image is composed, results. If this so-called indexing is too inaccurate, so that the indexing accuracy exceeds a definite tolerance of, for example, 50 μm, the human eye recognizes this indexing inaccuracy, and the quality of the printed image is judged to be bad. Moreover, it is necessary to arrange the printing formes, which are required for printing each of the different colors of the same printed image, on each of their respective cylinders 01 in such a way, that the printing formes of all of the print positions are aligned with each other as exactly as possible for forming or producing the common printed image during the printing process. This is called the side and the circumferential registration accuracy of the printing formes. In actuality, in indexing, as well as in side and in circumferential registration, accuracy of 10 μm and less is currently often demanded. The dimensional instability of the material 24 to be imprinted, which is caused particular, by the hygroscopic behavior of material 24, makes it necessary to arrange for the alignment of each of the respective dressings 02 placed on a cylinder 01, for example each of the printing formes 02, and in particular each of the printed images made by each of these printing formes 02, to be adaptable and to be adjustable with respect to each other during the ongoing printing process.

It is proposed, in accordance with the present invention, to provide at least one second actuating device 26, which is controllable from outside the print position, or from outside the printing unit, and which preferably is an actuator 26, which displaces a holding device displaceably arranged for axial movement in a groove 11. By the use of this second, laterally operating actuator 26, a dressing 02 is positioned on a cylinder 01, at least in the axial direction of the cylinder 01. The actuator 26 can be configured as a piezo-electric system or as a magnetostrictive system, which actuator 26 is arranged in a housing with an actuator head element 27 and with an actuator base element 28 and which actuator 26 has been inserted into the groove 11, typically wherein at least the base element 28 of the actuator housing is rigidly connected with the groove 11. The imposition of an applied electrical control signal, US, causes the head element 27 to make a translatory movement over a defined actuating path "s," while the base element 28 remains stationary. In this case, the actuating path "s" of an actuator 26 can lie in the range of approximately 100 μm. However, displacements of up to a total of 2 mm can be necessary.

The second actuating device 26, or the actuator 26, preferably perform a translatory movement in the axial direction of cylinder 01, for displacing the holding device 18, or the base body 22, arranged in the groove 11 in the cylinder axial direction. An actuator 26, which may be embodied as a piezo-electric system, utilizes a so-called indirect piezo effect, and essentially has a piezo-electrical body made of a crystalline, ferro-electric material, such as, for example, a quartz crystal, which material is elastically deformed when charged with an electrical field. If the piezo-electrical body is prevented from being deformed, a mechanical stress is created in the crystalline structure of the body, so that a force is exerted on the device that is preventing the body from being deformed. As a rule, charging the piezo-electric body with an electric field takes place by applying an electric voltage to electrodes which are attached to the piezo-electric body. Analogously, a magnetostrictive system, which may be used as an actuator 26, also has a body that is made of a material with magnetic properties, and which uses the physical effect of magnetostriction. This body can consist of a ferromagnetic metallic material, and wherein this body is surrounded by a coil in order to be able to charge the body with a magnetic field when an electric current is applied to the coil, which magnetic field causes the body to become elastically deformed. That deformation of the body can be used to apply a definite exertion of a force on a device which is connected with the body, if the body of the actuator 26 is firmly clamped on one side. The actuator 26 causes a displacement of the holding device, or of the base body 22, arranged in the groove 11, by the body of the actuator 26 being exited to perform a change in its length or shape, wherein the length or shape change of the body of the actuator 26 is triggered by a control signal US applied to it. A different preferred embodiment can provide a preferably electrically operable actuating device or actuator 26, for example an electric motor arranged in the groove 11, whose effective direction is axially aligned in respect to the groove 11.

Figure 3:
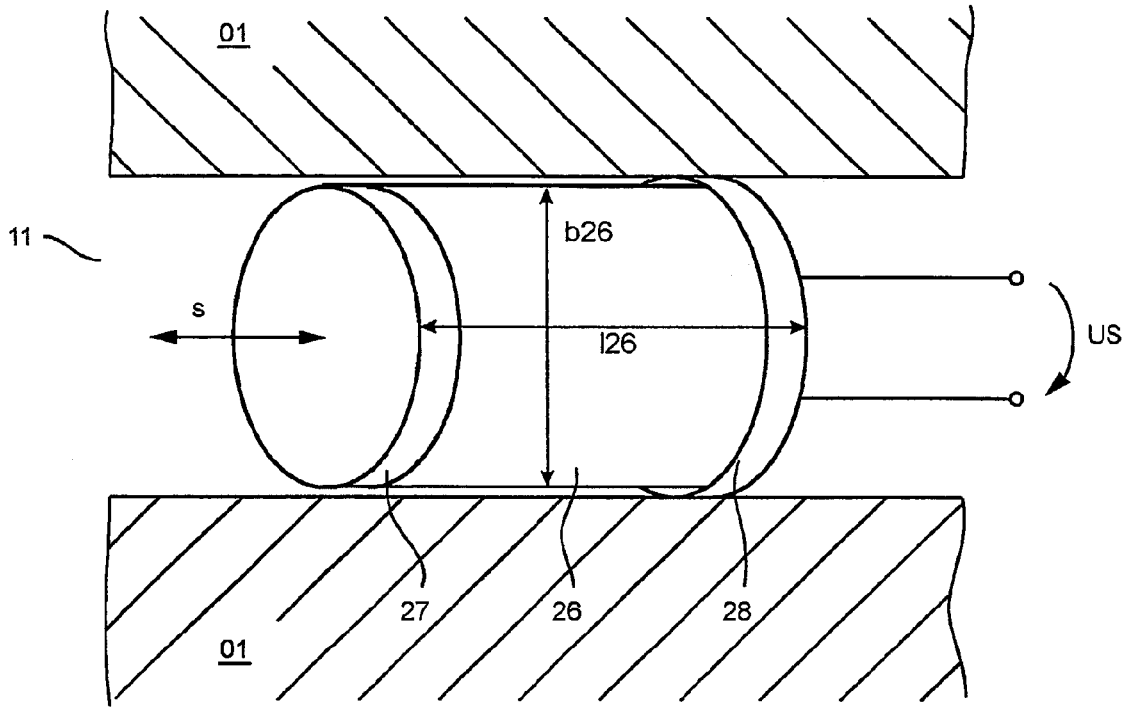

The housing of the actuator 26 can be arranged in the groove 11, for example, in such a way, in relation to a holding device 18, that the actuating path "s" shown in FIG. 3 caused by the head element 27 of the actuator 26 acts directly on the holding device 18, and the head element 27 of the actuator 26 displaces the holding device in a direction corresponding to the actuating path "s" in the groove 11. If the holding device 18 is arranged in a base body 22, as seen in FIG. 2, and is rigidly connected with the base body 22, the actuating path s caused by the actuator 26 preferably acts on the base body 22 arranged in the groove 11. To make a simple matching of at least the head element 27 of the actuator 26 to the holding device 18 to be displaced, or to the base body 22 to be displaced, it is advantageous to match the shape of the housing of the actuator 26 to the geometry of the groove 11 and, if necessary, to match at least the base element 28 to the groove 11 in the sense of providing a close fit. If the groove ills embodied as a circular bore, the cylindrical embodiment of the housing of the actuator 26 suggests itself. To provide as long as possible an actuating path "s" by the use of an actuator 26 utilizing the piezo effect or magnetostriction, it is advantageous to select a structural shape of the actuator 26 wherein the length 126 of the actuator 26, which length 126 extends in the same direction as the actuating path "s," is clearly greater than the actuator dimensions extending transversely to the actuator length l26. Thus, a ratio of the actuator length 126 to width b26 of the actuator 26 is at least 2:1, and, in particular, is greater than 4:1, from which there results a longer, narrower structural shape of the actuator 26. The effective direction and, corresponding to it, the installed position of the actuator 26, is always selected to be directed in the same way as the intended displacement of the holding device, or of the base body 22. the actuator 26 is at least 2:1, and, in particular, is greater than 4:1, from which there results a longer, narrower structural shape of the actuator 26. The effective direction and, corresponding to it, the installed position of the actuator 26, is always selected to be directed in the same way as the intended displacement of the holding device, or of the base body 22.

To achieve a longer actuating path "s" than can be generated by a single actuator 26, it is also possible to connect two or more, preferably identical actuators 26 in series, wherein only the actuator 26, which is located the farthest from the holding device 18 to be displaced, or from the base body 22 to be displaced, is rigidly connected with the groove 11. With the remaining actuators 26, a base element 28 of the next following actuator 26 is rigidly connected with the head element 27 of the previous actuator 26, so that the actuating paths "s" of the serially arranged actuators 26 can be added together when an electrical control signal US is simultaneously applied to the several serially arranged actuators 26.

By displacing the holding device 18, or the base body 22, in the groove 11 by the operation of a controllable actuating device 26, or actuator 26, it is possible to laterally displace a dressing 02, which has been applied to the cylinder 01 and which dressing 02 is held in place by the holding device 18. The controllable actuating device or actuator 26 can be operated by remote control, for example from a control console, while the printing process is running. In other words, the actuator 26 can be operated without a printing unit needing to be stopped. Because of this remote control operation of actuator 26, the position of the dressing 02, and therefore the printed image printed by it, can be aligned as needed in relation to the material 24 to be imprinted, which material 24 is stretched laterally or is fanned out in the direction Q, as seen in FIG. 1, in relation to the production direction P of the cylinder 01, or in relation to other print positions. Such lateral alignment of the dressing 02, through the operation of actuator 26 is done for the purpose of obtaining an improved indexing, as well as improved side and circumferential registration. If, in the course of the material 24 passing through the printing unit, the lateral extension Q of the material 24 to be imprinted changes from one print position to a further, subsequent print position, the actuating path "s," which is shown in FIG. 3 and which is provided by an actuating device 26, or actuator 26 arranged there in a cylinder 01, can be of different dimensions, for example can be longer from one print position to the next.

Several dressings 02, preferably from two to six dressings 02, can also be arranged in the axial direction of the cylinder 01, so that the controllable actuating device 26, or the actuator 26, can be utilized for changing a distance between two, preferably adjoiningly arranged, dressings over an actuating path "s," which path is oriented axially, in respect to the cylinder 01. It is advantageous, in accordance with the present invention if the at least one actuator 26 arranged in the groove 11, or the at least one controllable actuating device 26 arranged in the groove 11, displaces the two dressings 02 affected by the distance change simultaneously and in the same way over an actuating path "s" oriented axially with respect to the cylinder 01. It can also be provided that at least one actuator 26, or at least one controllable actuating device 26, and positioned in the groove 11, is assigned to each one of the dressings 02, which dressings 02 are arranged in the axial direction of the cylinder 01 on its surface area 09. If two grooves 11, which are arranged offset with respect to each other in the circumferential direction of the cylinder 01, are provided on a cylinder 01, at least one actuator 26, or at least one controllable actuating device 26, can be arranged in each groove 11. At least one holding device 18, for example, is assigned to each dressing 02, which maintains the dressing 02 on the surface area 09, wherein the actuator 26, or the controllable actuating device 26, changes a position of the holding device 18 holding the dressing 02 in the axial direction of the cylinder 01.

It is furthermore advantageous to provide a linear measuring system, which is configured as a DMS, or wire strain gauge full bridge, and to integrate it, for example, into the housing of the actuator 26 for use in determining the actuating path "s" provided by the actuator head element 27. The measurement result of such a linear measuring system is then transmitted, for evaluation, to a location outside of the cylinder 01, for example to a control console of the printing unit. The location of the printed image, or of reference markers, on the material to be imprinted 24 can be detected by the use of a sensor, which is directed onto the material 24 to be imprinted for determining an intended position of a printed image which had been imprinted at different print positions, for example by the use of an image sensor and, in particular a CCD camera. It is then possible to construct a regulating device, which corrects, as required, the actuating path "s" provided by the controllable actuating device 26 to the holding device 18 in the axial direction of this cylinder 01 by a comparison of the detected position of the printed image with the intended position of the printed image.

While a preferred embodiment of a cylinder of a web-fed printing press and of a printing unit, in accordance with the present invention has been set forth fully and completely hereinabove, it will be apparent to one of skill in the art that various changes in, for example, the drive for the cylinders, a source of supply of the material to be printed, and the like could be made without departing from the true spirit and scope of the present invention which is accordingly to be limited only by the following claims.

What is claimed is:

1. A cylinder of a printing press comprising:

at least a first cylinder groove beneath a surface of said cylinder, said first cylinder groove extending axially in said cylinder;

at least one dressing end holding device in said first cylinder groove and adapted to hold an end of a dressing supported on said surface of said cylinder; and a controllable actuator in said first cylinder groove and adapted in response to a control signal applied to said controllable actuator, to change a length of said controllable actuator axially in said first cylinder groove, said controllable actuator being in operative contact with said holding device to displace said holding device axially over an actuating path oriented axially in said cylinder.

2. The cylinder of claim 1 further including at least first and second dressings arranged in said axial direction on said cylinder surface.

3. The cylinder of claim 2 wherein said controllable actuator is operable to change a spacing distance between said at least first and second dressings over said actuating path.

4. The cylinder of claim 2 wherein said at least first and second dressings are arranged next to each other on said cylinder.

5. The cylinder of claim 2 further including a separate actuator assigned to each of said first and second dressings.

6. The cylinder of claim 2 further including at least one holding device for each of said first and second dressings, said actuator changing a position of each said holding device.

7. The cylinder of claim 1 further including a second cylinder groove offset from said first cylinder groove in a circumferential direction of said cylinder and at least one said actuator in each said groove.

8. The cylinder of claim 1 wherein said control signal is an electrical control signal.

9. The cylinder of claim 1 wherein said actuator performs a translatory movement for displacing said holding device.

10. The cylinder of claim 1 wherein said actuator has a length and a width, said length being greater than said width.

11. The cylinder of claim 1 wherein said actuator has an actuator length and an actuator width and wherein a ratio of said actuator length to said actuator width is greater than 2.

12. The cylinder of claim 1 wherein said actuating path is between 100 um and 2 mm.

13. The cylinder of claim 1 wherein said actuator is one of a piezo-electrical system and a magnetostrictive system.

14. The cylinder of claim 1 wherein said actuator is remotely controllable.

15. The cylinder of claim 1 wherein said actuator includes a housing, said housing being adapted to a shape of said at least first cylinder groove.

16. The cylinder of claim 1 wherein said actuator includes a head element and a base element, said head element being rigidly connected with said groove, said head element exerting a force on said holding device for moving said holding device.

17. The cylinder of claim 1 wherein said holding device includes at least one plate end holding element and a spring.

18. The cylinder of claim 17 wherein said holding element is a plate end clamping piece.

19. The cylinder of claim 17 wherein said holding element is a registration pin.

20. The cylinder of claim 1 further including a base body in said first cylinder groove, said holding device being positioned in said base body, said actuator displacing said base body.

21. The printing unit of claim 1 further including a plurality of said controllable actuators in said first cylinder groove and including a first actuator located remote from said holding device and a second actuator, said second actuator being said actuator in contact with said holding device, said first actuator being rigidly connected to said first cylinder groove, a remainder of said plurality of actuators being connected with each other, said actuating paths of said plurality of actuators being cumulative.

* * * * *